United States Patent [19]

Bauman et al.

[11] Patent Number: 4,981,092

[45] Date of Patent: Jan. 1, 1991

[54] FABRIC CLAMPING DEVICE FOR EMBROIDERY MACHINES

[75] Inventors: Dale Bauman, Groveport; Michael H. Ganon, Bexley, both of Ohio

[73] Assignee: R. G. Barry Corporation, Pickerington, Ohio

[21] Appl. No.: 437,598

[22] Filed: Nov. 17, 1989

[51] Int. Cl.[5] ..... D05C 9/04

[52] U.S. Cl. ..... 112/103; 112/102

[58] Field of Search ..... 112/86, 90, 102, 103, 112/121.12, 121.15; 38/102.3, 102.91

[56] References Cited

U.S. PATENT DOCUMENTS

| | | | |
|---|---|---|---|
| Re. 30,476 | 1/1981 | Jennen et al. | 38/102.2 |
| 1,171,847 | 2/1916 | Jensen | 112/90 |
| 1,512,868 | 10/1924 | Taylor | 112/90 |
| 2,091,727 | 8/1937 | Bohmann et al. | 112/102 |
| 3,034,458 | 5/1962 | Bennison | 112/2 |
| 3,216,383 | 11/1965 | Bono | 112/114 |
| 3,664,288 | 5/1972 | Von Boden et al. | 112/103 |
| 4,357,885 | 11/1982 | Stockton | 112/103 |
| 4,587,910 | 5/1986 | Raines | 112/121.12 |
| 4,723,367 | 2/1988 | Samoilov | 38/102.2 |

FOREIGN PATENT DOCUMENTS 888574 1/1962 United Kingdom .

*Primary Examiner*—Werner H. Schroeder
*Assistant Examiner*—Paul C. Lewis
*Attorney, Agent, or Firm*—Watson, Cole, Grindle & Watson

[57] ABSTRACT

A rectangular molded plastic body includes three heart-shaped clamping portions each of which defines an opening and has resilient inwardly extending arcuate portions terminating in ends spaced from one another. Each arcuate portion carries L-shaped members with upwardly extending conical portions. The outer end of one arcuate portion of each clamping portion has a sloping cam surface thereon which joins with a downwardly facing locking surface, and a handle is also formed on this outer end. Three clamping members are pivotally connected to the body by hinges and are pivotable into and out of the openings of the clamping portions. The clamping members engage the cam surfaces as they pivot into clamping position and are locked in place by the locking surfaces. The clamping members are released by pulling on the handles.

24 Claims, 2 Drawing Sheets

FABRIC CLAMPING DEVICE FOR EMBROIDERY MACHINES

BACKGROUND OF THE INVENTION

The present invention relates to a device for clamping one or more pieces of fabric in position to be embroidered by an automatic embroidery machine. Such machines include electronic circuitry which controls the motion of a traveller, which is mounted for movement along two perpendicular axes. The traveller is connected to the clamping device which is in turn slidably supported on the machine work table so that the clamping device can be moved to any desired position with respect to the sewing mechanism of the machine. The invention is especially adapted for use with multihead machines wherein a plurality of pieces of fabric are clamped in position relative to a plurality of needles.

Embroidery hoops such as shown in U.S. Pat. No. 3,818,620 have been employed in the prior art to support individual pieces of fabric to be embroidered. These hoops are supported by a spider adapted to support a plurality of hoops. Some spiders now in use are made of plywood having holes therein which receive and support the hoops. Such spiders have a number of problems. They are affected by temperature and humidity, and warpage is very common. They are also heavy and induce considerable wear on the associated embroidery machines.

Wooden spiders do not firmly support the hoops and the clamped fabric in position. As a result, the hoops are sometimes vibrated out of the spider. Furthermore, the number of irregulars as well as thread breakage from hoop bounce occurring with the use of wooden spiders is excessive. Accordingly, considerable maintenance is required which results in loss of productivity due to down time.

A clamping device as shown in U.S. Pat. No. 3,664,288 has also been proposed for use with embroidery machines. However, this type of device suffers from the disadvantages of being bulky, heavy and expensive in construction.

SUMMARY OF THE INVENTION

The present invention comprises a clamping device formed primarily of molded plastic components, thereby providing a construction which is resistant to temperature and moisture and which eliminates the problem of warpage. The invention device is less expensive than prior art spiders, and is lightweight, thereby reducing wear on the associated embroidery machines. The clamping devices are of uniform construction so that they can be readily interchanged with one another.

The construction is such that a resilient spring action is built into the device, and the need for separate hoops to hold the clamped fabric is eliminated. Pieces of fabric are securely clamped in place in a simple and effective manner, and can be quickly released after the embroidering operation is complete.

Since the pieces of fabric are more securely held in place, productivity is increased due to fewer irregularities and thread breaks; and less maintenance or down time is necessary. The useful life of the inventive clamping device is also significantly greater than wooden spiders employed to support conventional hoops.

DESCRIPTION OF THE PREFERRED EMBODIMENT

Figure 1:
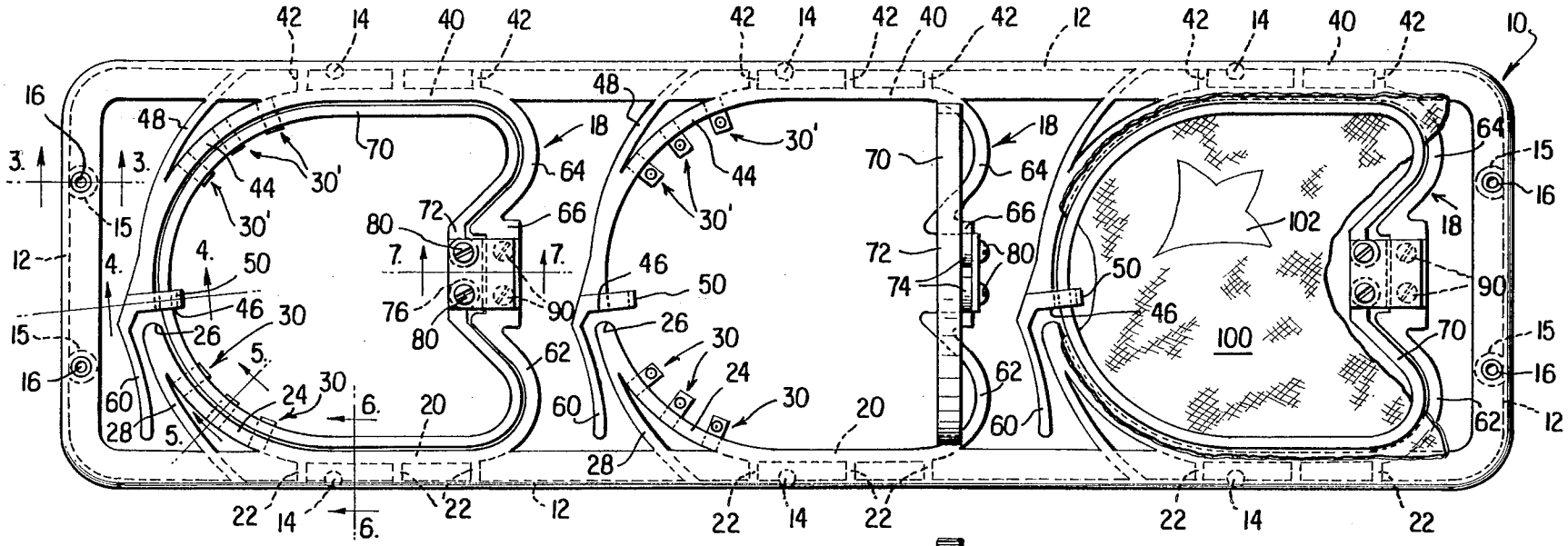
FIG. 1 is a top view of the clamping device incorporating three clamping mechanisms for clamping three separate pieces of fabric therein.
Figure 2:
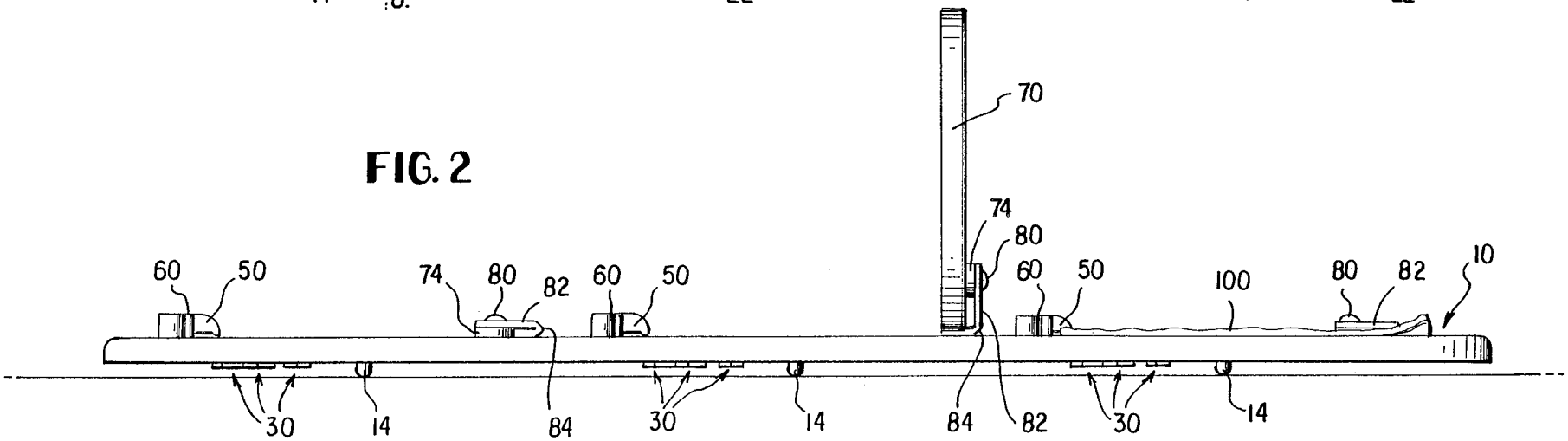
FIG. 2 is a front view of the device shown in FIG. 1.
Figure 3:
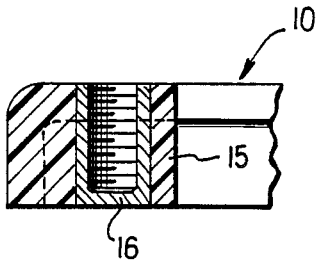
FIG. 3 is a sectional view taken along line 3—3 of FIG. 1 looking in the direction of the arrows.

Referring now to the drawings wherein like reference characters designate corresponding parts throughout the several views, as seen in FIGS. 1 and 2, a generally rectangular body means 100 is formed of molded plastic material such as Acetal-Delrin 500 or the like. The body means includes a depending flange portion 12 formed therearound. Integral standoff bosses 14, shown as being six in number, are spaced about the body means and extend downwardly therefrom. These bosses serve to space the body means above the work table of the embroidery machine and reduce friction between the clamping means and the work table. The body means also includes integral portions 15 as seen in FIGS. 1 and 3, each of these integral portions having brass inserts 16 molded therein. These inserts are threaded and have open upper ends which are exposed at the upper surface of the body means for receiving machine screws which secure the clamping means to the traveller of an embroidery machine.

The body means includes three separate clamping mechanisms indicated generally by reference numerals 18, each of these clamping mechanisms being generally heart-shaped in configuration. This configuration is optimal for embroidering the vamps of slippers and the like since it provides additional usable space as compared to the circular hoops employed in the prior art.

Each clamping mechanism comprises a first clamping means formed integral with the body means. Each of the first clamping means includes at one side of the body means an integral depending flange 20 at the inner side of the body means connected by spaced integral lateral flanges 22 with the depending flange 12 previously described. Flanges 20 include inwardly extending arcuate portions 24 which terminate in rounded ends 26 which join with the inner ends of further arcuate flanges 28 the cuter ends of which are formed integral with depending flange 12.

Figure 5:
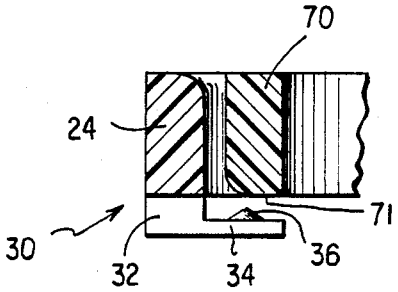
FIG. 5 is a sectional view taken along line 5—5 of FIG. 1 looking in the direction of the arrows.
Figure 6:
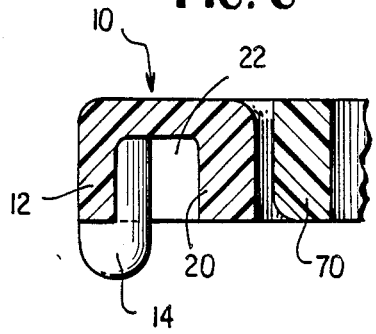
FIG. 6 is a sectional view taken along line 6—6 of FIG. 1 looking in the direction of the arrows.

Each arcuate portion 24 has formed integral therewith three spaced clamping means 30 each of which as seen in FIG. 5 is generally L-shaped including a vertical portion 32 and a horizontal portion 34. Fabric engaging means 36 comprises an integral upwardly extending portion which is conical in configuration and terminates in an apex defining a sharp point. The purpose of these clamping means is described hereinafter.

Each of the first clamping means includes at the opposite side of the body means an integral depending flange 40 at the inner side of the body means connected by spaced integral lateral flanges 42 with the depending flange 12 previously described. Flanges 40 include inwardly extending arcuate portions 44 which terminate in an end 46 which is spaced from the end 26 of arcuate portion 24. End 46 joins with the inner end of a further arcuate flange 48 the outer end of which is formed integral with depending flange 12. Each arcuate portion 44 has formed integral therewith three spaced clamping means 30' identical to clamping means 30 previously described.

Figure 4:
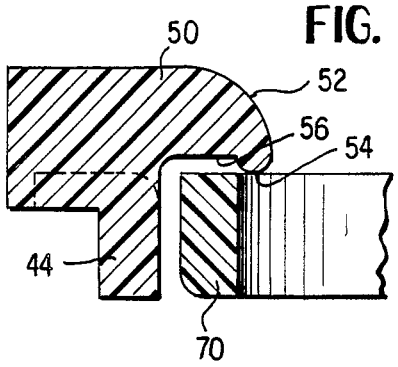
FIG. 4 is a sectional view taken along line 4—4 of FIG. 1 looking in the direction of the arrows.

The outer end 46 of each of arcuate portions 44 includes a vertically extending portion 50 which as seen in FIG. 4 has a downwardly sloping cam surface 52 formed thereon. The cam surface joins a rounded downwardly facing surface 54 which in turn joins with a substantially flat downwardly facing locking surface 56. The purposes of these various surfaces is described hereinafter.

A handle 60 is formed integral with the outer end 46 of each of the arcuate portions 44. The handle portion may be manually engaged and moved to the left as seen in FIGS. 1 and 2 to move end 46 away from end 26 to provide a quick release of a piece of fabric from the clamping mechanism as will become apparent from the following description.

Each of the first clamping means also includes an arcuate portion 62 integral with flange 20 as well as an arcuate portion 64 integral with flange 40. The inner ends of arcuate portions 62 and 64 are joined to an integral support portion 66. It will be noted that the inner surfaces of flanges 20 and 40 as well as integral arcuate portions 24, 44, 62, 64 and support portion 66 describe a generally heart-shaped central opening. Spaced ends 26 and 46 of each first clamping means are resilient and movable relative to one another.

Each of the clamping mechanisms also includes second clamping means 70 which is movably supported by the body means. Means 70 is formed of the same material as body means 12 and has a configuration which is also generally heart-shaped. Second clamping means 70 is received within the opening in the first clamping means with a slight clearance so that a piece of fabric can be clamped between the inner surface of the first clamping means and the outer surface of the second clamping means.

As seen in FIGS. 1 and 2, the left-hand clamping means 70 is shown in clamping position without a piece of fabric being clamped therein. The middle clamping means 70 shown as extending substantially perpendicular to body means 12 in a position which allows a piece of fabric to be placed on the first clamping means so that it can be subsequently clamped in position. The right-hand clamping means is shown in clamping position with a piece of fabric clamped therein and ready for embroidering. When the second clamping means is in clamping position, the upper surface and the lower surface thereof is substantially coplanar with the upper and lower surfaces respectively of body means 12 and the portions of the first clamping means integral therewith.

Figure 7:
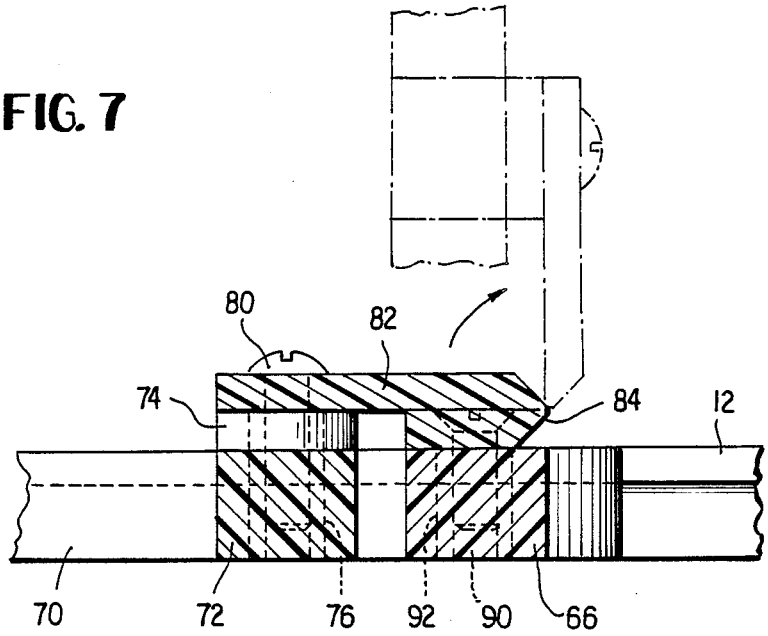
FIG. 7 is a sectional view taken along line 7—7 of FIG. 1 looking in the direction of the arrows.

Referring now to FIGS. 2 and 7 of the drawing, each of second clamping means 70 is provided with ar enlarged connecting portion 72 having a pair of integral spaced bosses 74 extending upwardly from the upper surface thereof. Brass inserts 76 are molded within these bosses and connecting portion. The inserts are threaded and receive screws 80 for connecting clamping means 70 to one end of a hinge 82 having suitable holes formed therethrough for receiving the screws. Hinge 82 comprises an elongated flat piece of flexible plastic material having a portion 84 of reduced thickness thereby providing a so-called "live hinge". One end of the hinge is connected to second clamping means 70, and the opposite end of the hinge is connected to support portion 66 of the first clamping means by a pair of flat head screws 90 which extend through suitable holes formed through the opposite end of the hinge and are threaded into threaded brass inserts 92 molded into support portion 66.

The second clamping means 70 is shown in solid lines in the clamping position in FIG. 7, and hinge 82 permits this clamping means to be pivoted or swung into the phantom line position shown in this figure. When clamping means 70 is in the vertical position as shown in FIG. 7 and in the middle clamping mechanism in FIG. 2, a sheet of fabric may be placed on the first clamping means defined by portions 24, 28, 44, 48, 62, 64 and 66 as well as the upper surface of body means 10 above flanges 20 and 40. When so supported, clamping means 70 may be swung downwardly to clamp a piece of fabric 100 in position between the inner surface of the first clamping means and the outer surface of the second clamping means as shown in the right-hand clamping mechanism in FIGS. 1 and 2.

As the second clamping means 70 swings downwardly, the lower surface thereof will engage the upper surface 52 of the first clamping means. Surface 52 serves as a cam surface to urge the resilient arcuate portion 44 of the first clamping means to the left as seen in FIGS. 1 and 2 so that clamping means 70 can move downwardly past the rounded surface 54 of the first clamping means, whereupon arcuate portion 44 will snap back into the position shown in FIG. 4. In this position, locking surface 56 prevents upward movement of clamping means 70 out of clamping position and accidental release of a clamped piece of fabric When in the position shown in FIG. 4, rounded surface 54 of the first clamping means may cooperate with the upper inner edge of second clamping means 70 to additionally clamp a piece of fabric in place to further ensure that the piece of fabric is firmly held in position during the embroidering operation.

Although the first and second clamping means normally hold a piece of fabric firmly in position, in some cases the piece of fabric may be slightly too small to be firmly held in position by these two clamping means. In such a case, the third clamping means 30 and 30' cooperate with the undersurfaces 71 of an associated second clamping means 70 to clamp a piece of fabric therebetween in operative position. It is noted that the third clamping means 30 and 30' extend inwardly of and below the associated first clamping means and are disposed below the undersurface of an associated second clamping means when in clamping position as shown in FIG. 5.

As seen in FIGS. 1 and 2, the piece of fabric 100 is shown as comprising the vamp of a slipper In this case, the shape of the vamp is such that the fabric is not clamped between surface 54 of the first clamping means and the second clamping means. However, when a piece of fabric of different configuration is employed, the fabric may be clamped in position by these components.

An embroidered area is indicated at 102 in FIG. 1, it being understood that the needles penetrate the fabric from above the sheet of fabric. When the embroidering operation is completed handles 60 may be moved to the left as seen in FIGS. 1 and 2, until clamping means clears portion 50, whereupon the clamping means will pop upwardly. The clamping means 70 can then be readily lifted further in an upward direction and the piece of fabric lifted off the clamping device to provide a quick release of the embroidered fabric.

The invention has been described with reference to a preferred embodiment. Obviously, modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. A fabric clamping device for embroidery machines comprising a body means including a first clamping means defining an opening therewithin, said first clamping means including spaced portions movable relative to one another, second clamping means, and hinge means swingably connecting said second clamping means to said body means for movement into said opening to clamp a piece of fabric between an inner surface of said first clamping means and an outer surface of said second clamping means, said second clamping means being swingable out of said opening to release said piece of fabric from the device.

2. A device as defined in claim 1 wherein one of said spaced portions of said first clamping means and said second clamping means have interengageable surfaces thereon for urging said one of said spaced portions away from the other spaced portion when said second clamping means is swung into said opening.

3. A device as defined in claim 1 wherein one of said spaced portions of said first clamping means includes locking means for locking said second clamping means in a clamped position.

4. A device as defined in claim 3 wherein said one of said spaced portions includes manually engageable means for moving said one spaced portion to release said locking means to afford quick release of a clamped piece of fabric.

5. A device as defined in claim 3 wherein said one of said spaced portions includes a rounded clamping portion adjacent said locking means for additionally clamping said piece of fabric between said first and second clamping means.

6. A device as defined in claim 1 including a third clamping means supported by said first clamping means and disposed beneath said second clamping means when disposed in said opening for clamping said piece of fabric between said second clamping means and said third clamping means.

7. A device as defined in claim 6 wherein said third clamping means comprises a plurality of spaced integral generally L-shaped members having engaging means extending upwardly therefrom for engaging said piece of fabric.

8. A device as defined in claim 1 including a plurality of spaced integral standoff bosses extending downwardly from said body means.

9. A device as defined in claim 1 wherein said hinge means comprises a live hinge.

10. A device as defined in claim 1 wherein when said second clamping means is disposed within said opening, upper surfaces of said first and second clamping means are substantially coplanar.

11. A fabric clamping device for embroidery machines comprising an integral body means formed of plastic material having first clamping means defining an opening therein and including spaced resilient portions movable relative to one another, second clamping means, and hinge means pivotally connecting said second clamping means to said body means and said second clamping mean being pivotable relative to said first clamping means for movement into said opening with an outer surface of said second clamping means being substantially complementary to and spaced slightly from an inner surface of said first clamping means to enable a piece of fabric to be clamped between said surfaces, said second clamping means being pivotable relative to said first clamping means for movement out of said opening to release the piece of fabric from the device.

12. A device as defined in claim 11 wherein one of said spaced portions of said first clamping means and said second clamping means have interengageable surfaces thereon for urging said one of said spaced portions away from another of said spaced portion when said second clamping means is swung into said opening.

13. A device as defined in claim 11 wherein one of said spaced portions of said first clamping means includes locking means for locking said second clamping means in a clamped position.

14. A device as defined in claim 13 wherein said one of said spaced portions includes manually engageable means for moving said one spaced portion to release said locking means to afford quick release of a clamped piece of fabric.

15. A device as defined in claim 11 including a third clamping means supported by said first clamping means and disposed beneath said second clamping means when disposed in said opening for clamping said piece of fabric between said second clamping means and said third clamping means.

16. A device as defined in claim 15 wherein said third clamping means comprises a plurality of spaced integral generally L-shaped members having engaging means extending upwardly therefrom for engaging said piece of fabric.

17. A device as defined in claim 12 wherein said hinge means comprises a live hinge.

18. A fabric clamping device for embroidery machines comprising a body means, a plurality of first clamping means formed integral with said body means, each of said first clamping means defining an opening and including a pair of spaced portions at least one of which is resilient so as to be movable relative to the other of said portions, a plurality of second clamping means, a plurality of hinge means each of which pivotally connects one of said second clamping means to said body means for pivotal movement into the opening defined by an associated first clamping means to clamp a separate piece of fabric between each of said second clamping means and said associated first clamping means, each of said second clamping means being pivotable out of the opening of the associated first clamping means to release the piece of fabric clamped therebetween.

19. A device as defined in claim 18 wherein one of said spaced portions of each of said first clamping means and the associated second clamping means have interengageable surfaces thereon for urging said one of said spaced portions away from another of said spaced portions when said second clamping means is swung into said opening.

20. A device as defined in claim 18 wherein one of said spaced portions of each of said first clamping means includes locking means for locking the associated second clamping means in a clamped position.

21. A device as defined in claim 20 wherein said one of said spaced portions of each of said first clamping means includes manually engageable means for moving said one of said spaced portions to release said locking means to afford quick release of a clamped piece of fabric.

22. A device as defined in claim 18 including a third clamping means supported by each of said first clamping means and disposed beneath an associated said second clamping means when the second clamping means is disposed in an associated opening for clamping a piece of fabric between one of said second clamping means and an associated third clamping means.

23. A device as defined in claim 22 wherein each of said third clamping means comprises a plurality of spaced integral generally L-shaped members having engaging means extending upwardly therefrom for engaging said piece of fabric.

24. A device as defined in claim 20 wherein each of said hinge means comprises a live hinge.

* * * * *